US011477595B2

(12) United States Patent
Nakano

(10) Patent No.: US 11,477,595 B2
(45) Date of Patent: Oct. 18, 2022

(54) AUDIO PROCESSING DEVICE AND AUDIO PROCESSING METHOD

(71) Applicant: SONY CORPORATION, Tokyo (JP)

(72) Inventor: Kenji Nakano, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/044,933

(22) PCT Filed: Feb. 4, 2019

(86) PCT No.: PCT/JP2019/003804
§ 371 (c)(1),
(2) Date: Oct. 2, 2020

(87) PCT Pub. No.: WO2019/198314
PCT Pub. Date: Oct. 17, 2019

(65) Prior Publication Data

US 2021/0168549 A1 Jun. 3, 2021

(30) Foreign Application Priority Data

Apr. 10, 2018 (JP) ..... JP2018-075652

(51) Int. Cl.
*H04S 7/00* (2006.01)
*H04R 5/02* (2006.01)
*H04S 1/00* (2006.01)

(52) U.S. Cl.
CPC ..... *H04S 7/303* (2013.01); *H04R 5/02* (2013.01); *H04S 1/002* (2013.01); *H04S 1/007* (2013.01); *H04S 2400/11* (2013.01)

(58) Field of Classification Search
None
See application file for complete search history.

(56) References Cited

U.S. PATENT DOCUMENTS 4,975,954 A 12/1990 Cooper et al.
6,643,375 B1 * 11/2003 Philp ..... H04S 1/005 381/1
2005/0078833 A1 * 4/2005 Hess ..... G01S 5/18 381/26
2006/0182284 A1 * 8/2006 Williams ..... H04S 1/002 381/17

(Continued)

FOREIGN PATENT DOCUMENTS

EP 2061279 A2 5/2009
JP 09-046800 A 2/1997

(Continued)

OTHER PUBLICATIONS

International Search Report and Written Opinion of PCT Application No. PCT/JP2019/003804, dated Apr. 23, 2019, 10 pages of ISRWO.

*Primary Examiner* — Qin Zhu
(74) *Attorney, Agent, or Firm* — Chip Law Group

(57) ABSTRACT

An audio processing device, including: a trans-aural processing unit configured to perform trans-aural processing with respect to a predetermined audio signal; and a correction processing unit configured to perform correction processing in accordance with a change in a listening position with respect to the audio signal having been subjected to the trans-aural processing.

9 Claims, 14 Drawing Sheets

(56) References Cited

U.S. PATENT DOCUMENTS

| | | | | |
|---|---|---|---|---|
| 2007/0154019 | A1* | 7/2007 | Kim | H04S 1/00 381/17 |
| 2008/0025534 | A1* | 1/2008 | Kuhn | H04S 7/30 381/300 |
| 2009/0123007 | A1* | 5/2009 | Katayama | H04S 7/302 381/300 |
| 2014/0064493 | A1 | 3/2014 | Kim | |
| 2018/0184227 | A1* | 6/2018 | Chon | H04S 3/008 |

FOREIGN PATENT DOCUMENTS

| | | | |
|---|---|---|---|
| JP | 2007-028198 | A | 2/2007 |
| JP | 2009-124395 | A | 6/2009 |
| KR | 10-2007-0066820 | A | 6/2007 |
| WO | 89/003632 | A | 4/1989 |

* cited by examiner

AUDIO PROCESSING DEVICE AND AUDIO PROCESSING METHOD

CROSS REFERENCE TO RELATED APPLICATIONS

This application is a U.S. National Phase of International Patent Application No. PCT/JP2019/003804 filed on Feb. 4, 2019, which claims priority benefit of Japanese Patent Application No. JP 2018-075652 filed in the Japan Patent Office on Apr. 10, 2018. Each of the above-referenced applications is hereby incorporated herein by reference in its entirety.

TECHNICAL FIELD

The present disclosure relates to an audio processing device, an audio processing method, and a program.

BACKGROUND ART

Audio processing devices that perform delay processing with respect to an audio signal and processing for changing a location of sound image localization in accordance with a change in a position of a user who is a listener are being proposed (for example, refer to PTL 1 and PTL 2 below).

CITATION LIST

Patent Literature

[PTL 1]
JP 2007-142856A
[PTL 2]
JP H09-46800A

SUMMARY

Technical Problem

Meanwhile, a trans-aural reproduction system which reproduces a binaural signal with a speaker apparatus instead of headphones is being proposed. The techniques described in PTL 1 and PTL 2 above do not take into consideration the fact that an effect of trans-aural processing diminishes in accordance with a change in a position of a listener.

In consideration thereof, an object of the present disclosure is to provide an audio processing device, an audio processing method, and a program which perform correction processing with respect to an audio signal having been subjected to trans-aural processing in accordance with a change in a position of a listener.

Solution to Problem

The present disclosure is, for example, an audio processing device including;

a trans-aural processing unit configured to perform trans-aural processing with respect to a predetermined audio signal; and a correction processing unit configured to perform correction processing in accordance with a change in a listening position with respect to the audio signal having been subjected to the trans-aural processing.

The present disclosure is, for example, an audio processing method including:

a trans-aural processing unit performing trans-aural processing with respect to a predetermined audio signal; and a correction processing unit performing correction processing in accordance with a change in a listening position with respect to the audio signal having been subjected to the trans-aural processing.

The present disclosure is, for example, a program that causes a computer to execute an audio processing method including:

a trans-aural processing unit performing trans-aural processing with respect to a predetermined audio signal; and a correction processing unit performing correction processing in accordance with a change in a listening position with respect to the audio signal having been subjected to the trans-aural processing.

Advantageous Effects of Invention

According to at least one embodiment of the present disclosure, an effect of trans-aural processing can be prevented from becoming diminished due to a change in a position of a listener. It should be noted that the advantageous effect described above is not necessarily restrictive and any of the advantageous effects described in the present disclosure may apply. In addition, it is to be understood that contents of the present disclosure are not to be interpreted in a limited manner according to the exemplified advantageous effects.

DESCRIPTION OF EMBODIMENTS

Hereinafter, embodiments and the like of the present disclosure will be described with reference to the drawings. The description will be given in the following order.

<Problem that should be taken into consideration in the embodiment>

<Overview of embodiment>

<First embodiment>

<Second embodiment>

<Modifications>

It is to be understood that the embodiments and the like described below are preferable specific examples of the present disclosure and that contents of the present disclosure are not limited to the embodiments and the like.

Problem that should be Taken into Consideration in the Embodiment

In order to facilitate understanding of the present disclosure, first, a problem that should be taken into consideration in the embodiment will be described. It is said that, in so-called trans-aural reproduction, an area (hereinafter, referred to as a service area when appropriate) in which an effect thereof is obtained is extremely narrow and localized (pinpoint-like). A decline in a trans-aural effect becomes significant particularly when a listener deviates to the left or the right with respect to a speaker apparatus that reproduces an audio signal.

Therefore, even if the service area is localized, when the service area can be moved in accordance with a listening position of a listener to the listening position and, consequently, when a trans-aural effect can be obtained at various positions, usability should improve significantly.

Generally, as a method of moving a service area, a conceivable technique involves equalizing arrival times or signal levels of audio signals at a listener from a plurality of speaker apparatuses (for example, in a case of 2-channel speaker apparatuses, two). However, such methods are insufficient for satisfactorily obtaining a trans-aural effect. This is because, despite matching a viewing angle from a listener to a speaker apparatus with a viewing angle according to a service area being essential for obtaining a trans-aural effect, the method described above cannot satisfy this requirement.

Figure 1B:
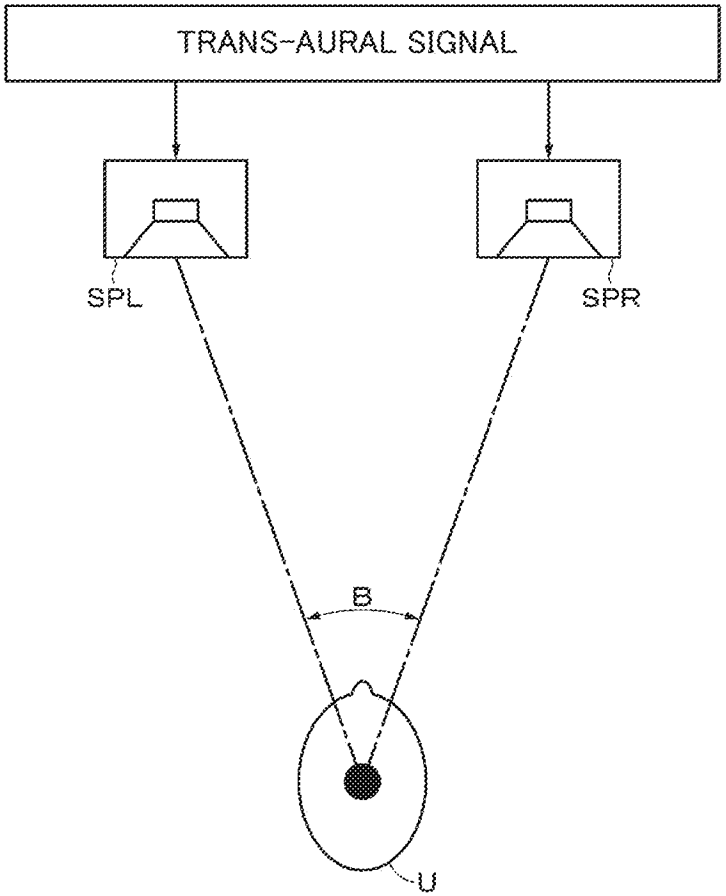
FIGS. 1A and 1B are diagrams for explaining a problem that should be taken into consideration in an embodiment.
Figure 1A:
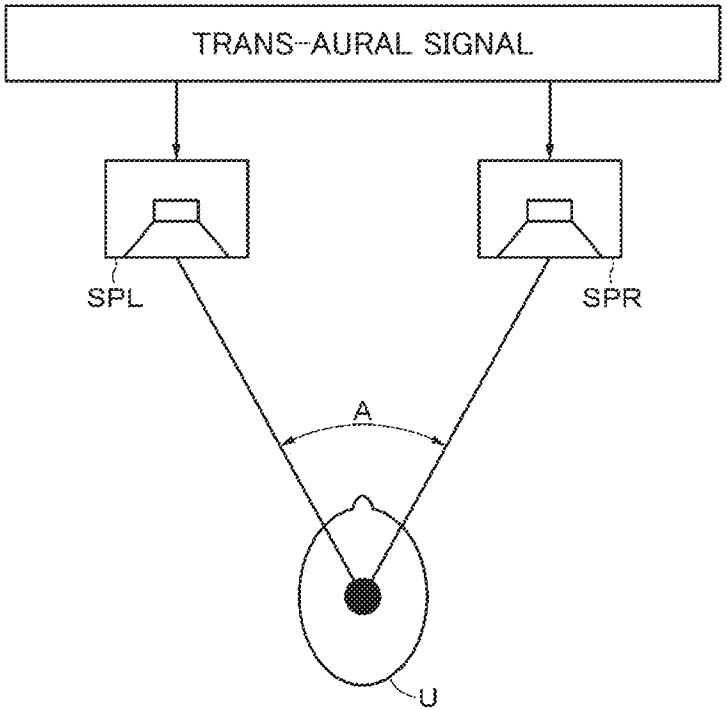

This point will be explained with reference to FIGS. 1A and 1B. FIGS. 1A and 1B are diagrams schematically showing speaker apparatuses and a listening position of a listener when performing a trans-aural reproduction of a 2-channel audio signal. An L (left)-channel audio signal (hereinafter, referred to as a trans-aural signal when appropriate) having been subjected to trans-aural processing is supplied to and reproduced by a speaker apparatus SPL (hereinafter, referred to as a real speaker apparatus SPL when appropriate) that is an actual speaker apparatus. In addition, an R (right)-channel trans-aural signal having been subjected to trans-aural processing is supplied to and reproduced by a speaker apparatus SPR (hereinafter, referred to as a real speaker apparatus SPR when appropriate) that is an actual speaker apparatus. The listening position is set on, for example, an extension of a central axis of two real speaker apparatuses (on an axis which passes through a center point between the two real speaker apparatuses and which is approximately parallel to a radiation direction of sound). In other words, from the perspective of the listener, the two real speaker apparatuses are arranged at positions that are approximately symmetrical.

An angle (in the present specification, referred to as a viewing angle when appropriate) that is formed by at least three points having, as vertices, positions of two speaker apparatuses (in the present example, positions of the real speaker apparatuses SPL and SPR) and the listening position of the listener U is represented by A [deg]. The viewing angle A [deg] shown in FIG. 1A is assumed to be angle at which an effect of trans-aural reproduction is obtained. In other words, the listening position shown in FIG. 1A is a position corresponding to a service area. The viewing angle A [deg] is, for example, an angle set in advance, and based on settings corresponding to the viewing angle A [deg], signal processing optimized for performing trans-aural reproduction is performed.

FIG. 1B shows a state in which a listener U has retreated and the listening position has deviated from the service area. In accordance with a change in the listening position of the listener U, the viewing angle changes from A [deg] to B [deg] (where A>B). Since the listening position has deviated from the service area, the effect of trans-aural reproduction diminishes.

Figure 2B:
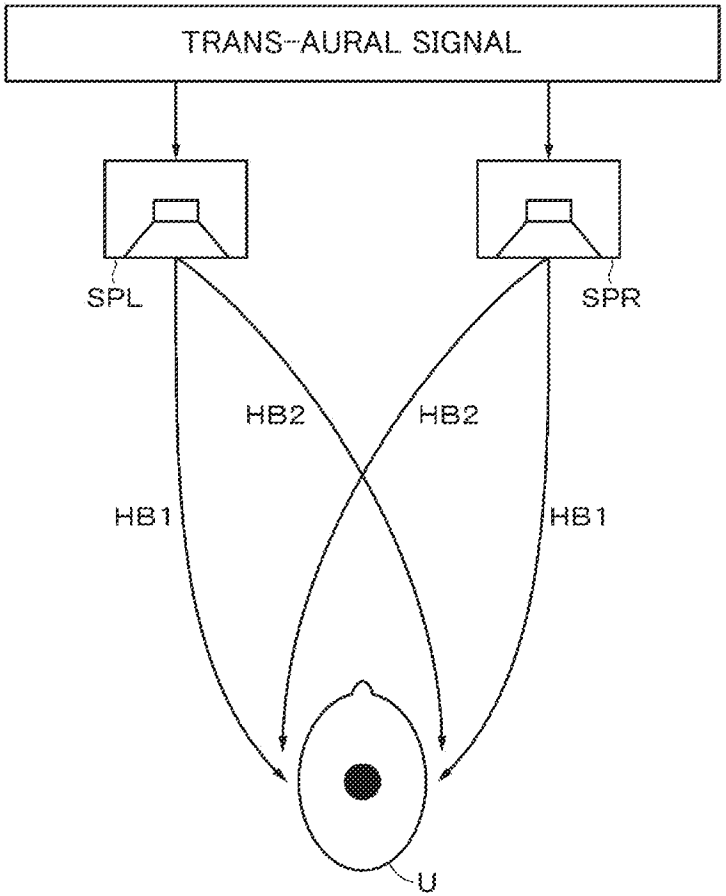
FIGS. 2A and 2B are diagrams for explaining a problem that should be taken into consideration in the embodiment.
Figure 2A:
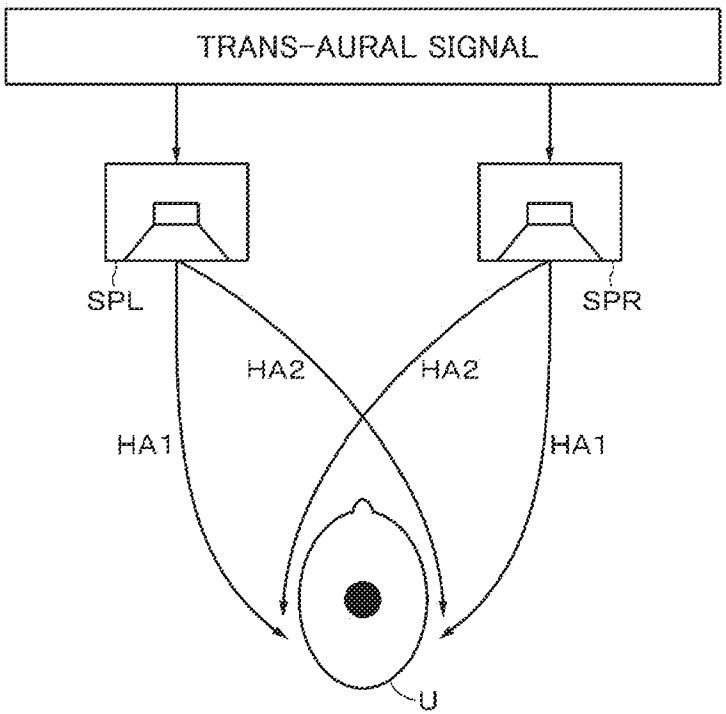

This phenomenon can be interpreted as follows. There is a significant difference between HRTF {HA1, HA2} that is a head related transfer function (HRTF) from the real speaker apparatuses SPL and SPR to the listener U in a case where the listening position of the listener U corresponds to the service area as shown in FIG. 2A and HRTF {HB1, HB2} that is a head related transfer function from the real speaker apparatuses SPL and SPR to the listener U in a case where the listening position has deviated from the service area as shown in FIG. 2B. It should be noted that HRTF is an impulse response measured near an entrance to an ear canal of a listener with respect to an impulse signal emitted from an arbitrarily arranged sound source.

Figure 3A:
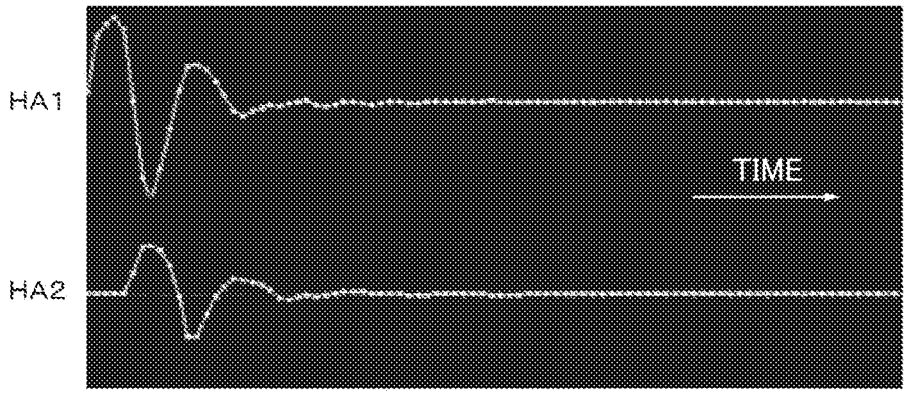
FIGS. 3A and 3B are diagrams showing a time-base waveform of transfer functions according to the embodiment.
Figure 3B:
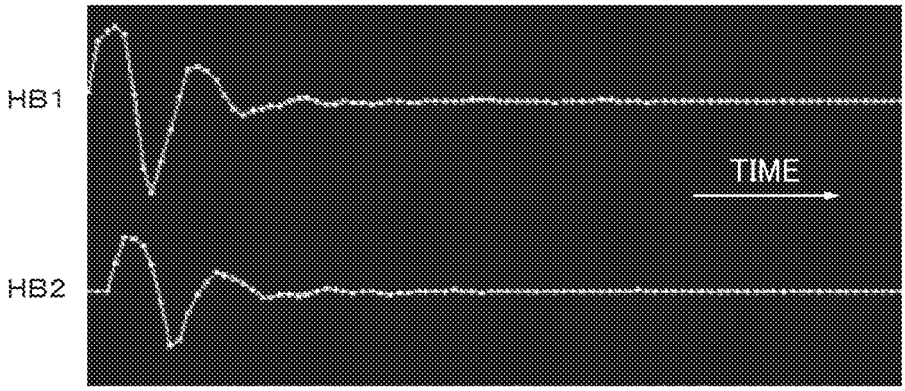

Specific examples of HRTF {HA1, HA2} and HRTF {HB1, HB2} will be described with reference to FIGS. 3A, 3B, 4A, 4B, 5A, and 5B. FIG. 3A shows a time-base waveform of HRTF {HA1, HA2}. A viewing angle is, for example, 24 [deg]. FIG. 3B shows a time-base waveform of HRTF {HB1, HB2}. A viewing angle is, for example, 12 [deg]. In both cases, a sampling frequency is 44.1 [kHz].

As shown in FIG. 3A, regarding HA1 since a distance from one real speaker apparatus to the ears is short, an earlier rise in level is observed as compared to HA2. Subsequently, a rise in level of HA2 is observed. Regarding HA2, given that a distance from one real speaker apparatus to one ear increases and since the ear is a shade-side ear as viewed from the real speaker apparatus, the level of the rise is smaller than that of HA1.

As shown in FIG. 3B, regarding HB1 and HB2, similar changes to HA1 and HA2 are observed. However, due to a rearward movement of the listener U, a distance difference from the speaker apparatus to each ear decreases. Therefore, a lag in a rise timing of signal levels and a difference in signal levels after the rise are smaller compared to HA1 and HA2.

Figure 4A:
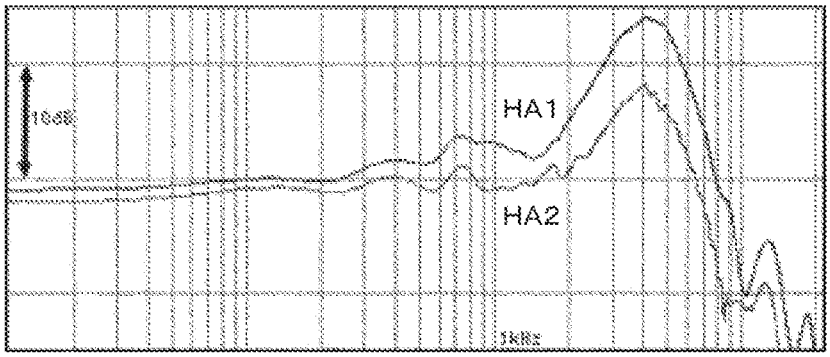
FIGS. 4A and 4B are diagrams showing frequency-amplitude characteristics of transfer functions according to the embodiment.
Figure 4B:
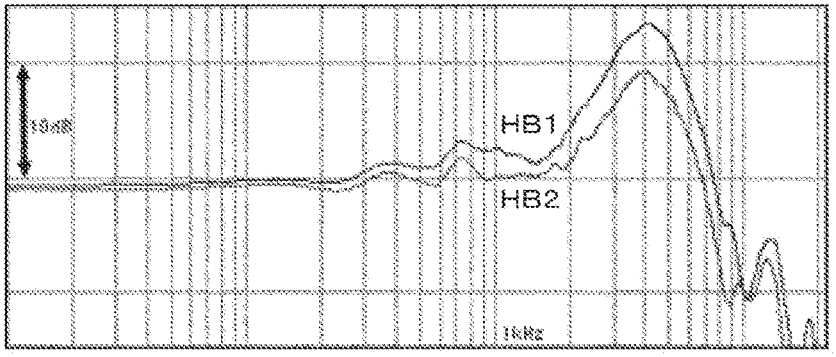

FIG. 4A shows frequency-amplitude characteristics of HRTF {HA1, HA2}, and FIG. 4B shows frequency-amplitude characteristics of HRTF {HB1, HB2} (it should be noted that FIGS. 4A and 4B are represented by a double logarithmic plot and FIGS. 5A and 5B to be described later is represented by a semilogarithmic plot). In FIGS. 4A and 4B, an abscissa indicates frequency and an ordinate indicates amplitude (signal level). As shown in FIG. 4A, in all bands, a level difference is observed between HA1 and HA2. In addition, as shown in FIG. 4B, in all frequency bands, a level difference is similarly observed between HB1 and HB2. However, in the case of HB1 and HB2, since a difference between distances from one real speaker apparatus to each ear is smaller, a level difference is smaller than a level difference between HA1 and HA2.

Figure 5A:
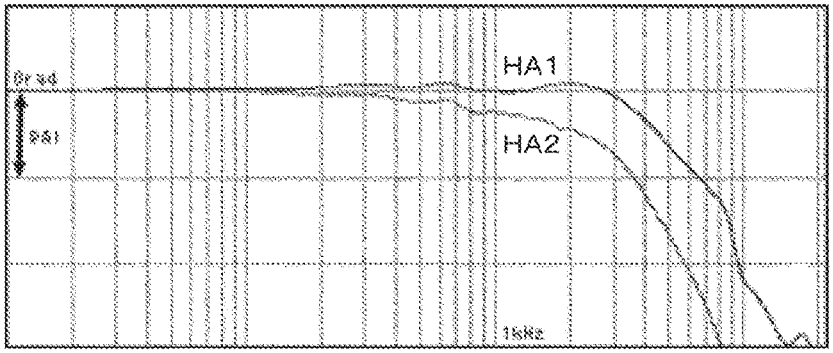
FIGS. 5A and 5B are diagrams showing frequency-phase characteristics of transfer functions according to the embodiment.
Figure 5B:
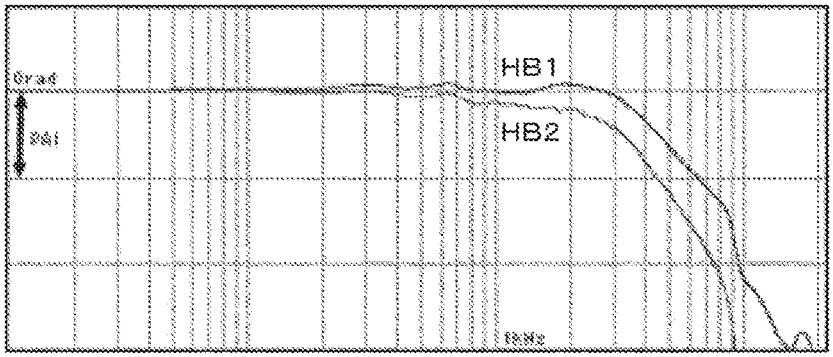

FIG. 5A shows frequency-phase characteristics of HRTF {HA1, HA2}, and FIG. 5B shows frequency-phase characteristics of HRTF {HB1, HB2}. In FIGS. 5A and 5B, an abscissa indicates frequency and an ordinate indicates phase. As shown in FIG. 5A, the higher the frequency band, a phase difference is observed between HA1 and HA2. In addition, as shown in FIG. 5B, the higher the frequency band, a phase difference is also observed between HB1 and HB2. However, in the case of HB1 and HB2, since a difference between distances from one real speaker apparatus to each ear is smaller, a phase difference is smaller than a phase difference between HA1 and HA2.

Overview of Embodiment

Figure 6:
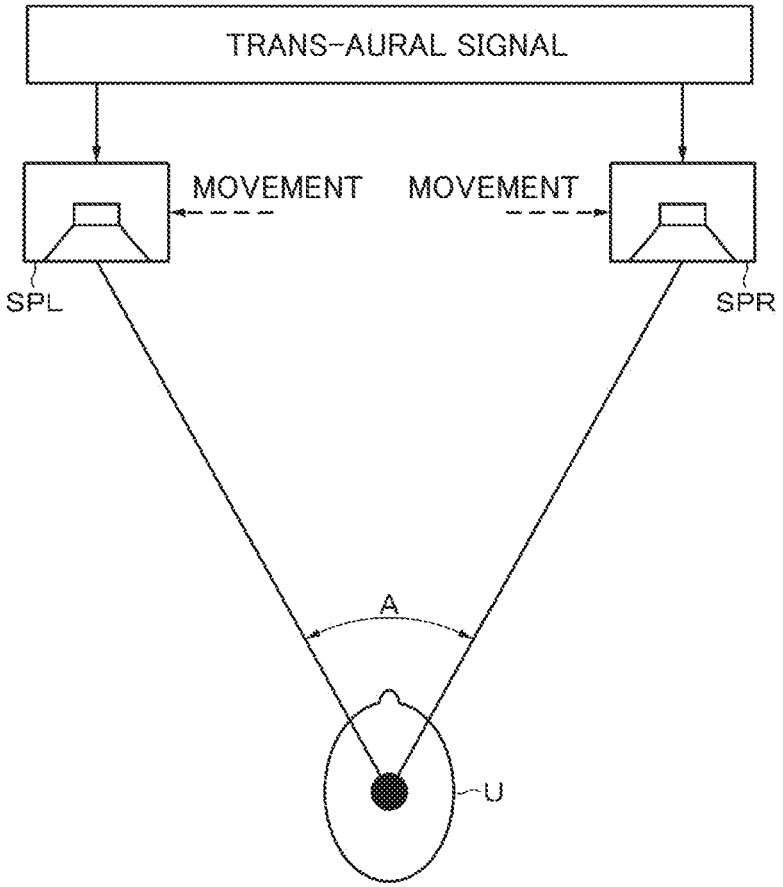
FIG. 6 is a diagram for explaining an overview of the embodiment.
Figure 7:
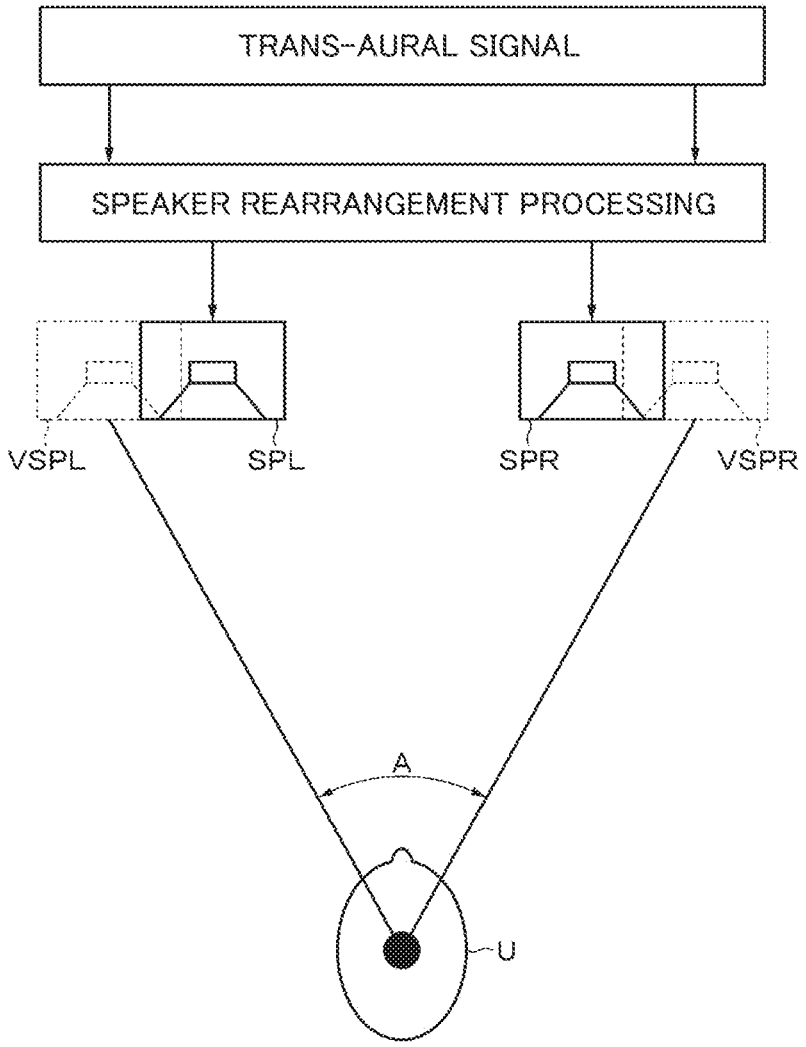
FIG. 7 is a diagram for explaining an overview of the embodiment.

In order to deal with the problem that should be taken into consideration described above, with respect to the listener U having deviated from a service area, it will suffice to create an environment in which an audio signal arrives at the ears of the listener U with characteristics of HRTF {HA1, HA2} instead of HRTF {HB1, HB2} from a real speaker apparatus arranged at a position where the viewing angle is A [deg]. In other words, as shown in FIG. 6, it will suffice to create an environment in which the viewing angle is A [deg] by moving the real speaker apparatuses SPL and SPR. However, in reality, the real speaker apparatuses SPL and SPR themselves cannot be physically moved or it is difficult or inconvenient to do so as shown in FIG. 6. Therefore, in the present embodiment, as shown in FIG. 7, imaginary speaker apparatuses (hereinafter, referred to as virtual speaker apparatuses when appropriate) VSPL and VSPR are set. In addition, correction processing is performed in which positions of the two real speaker apparatuses SPL and SPR are virtually rearranged at positions of the two virtual speaker apparatuses VSPL and VSPR so that an angle formed by the positions of the virtual speaker apparatuses VSPL and VSPR and the listening position matches the viewing angle A [deg]. It should be noted that, in the following description, the correction processing will be referred to as speaker rearrangement processing when appropriate.

First Embodiment (Configuration Example of Audio Processing Device)

Figure 8:
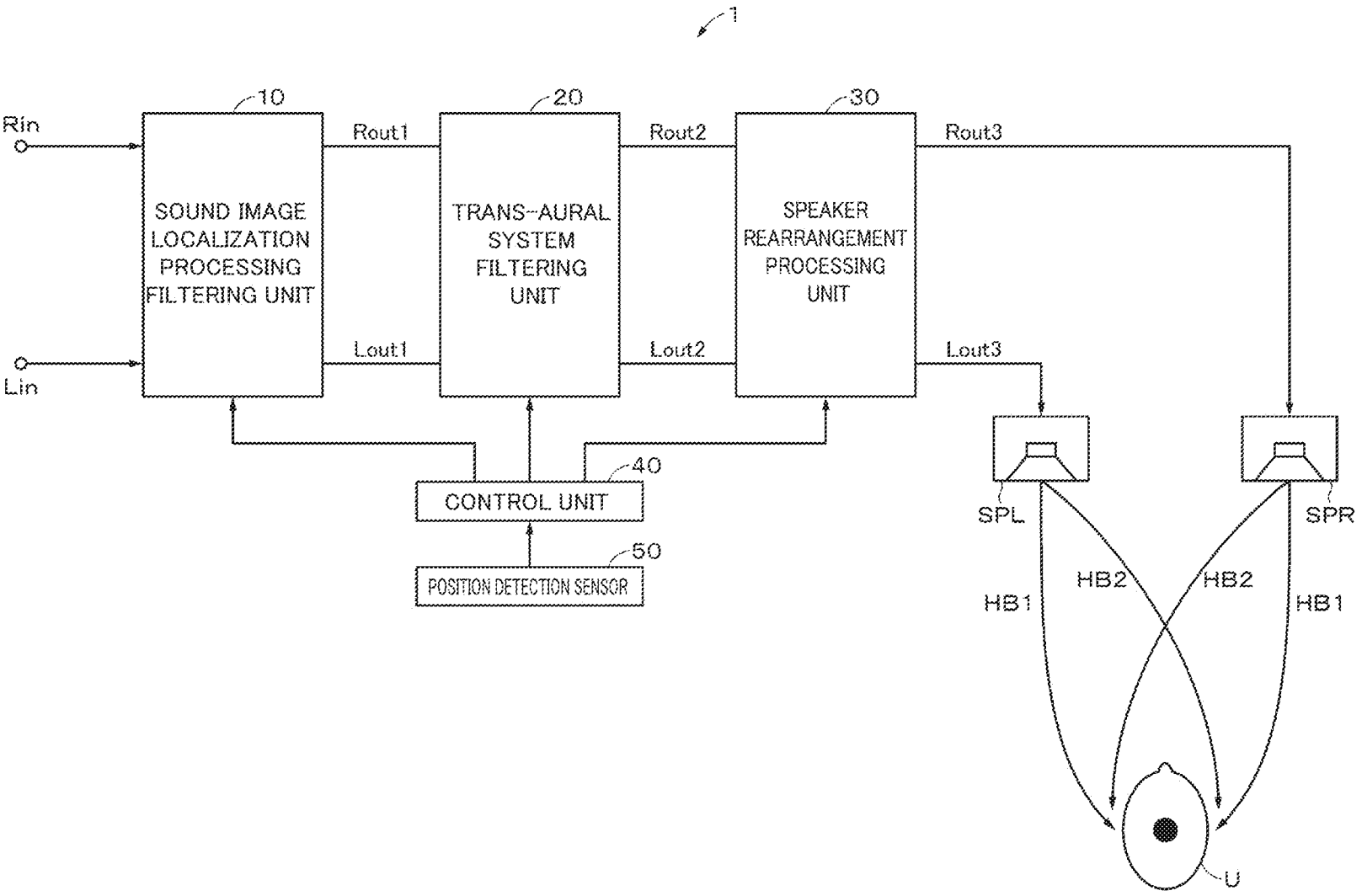
FIG. 8 is a diagram for explaining a configuration example of an audio processing device according to a first embodiment.

FIG. 8 is a block diagram showing a configuration example of an audio processing device (an audio processing device 1) according to a first embodiment. For example, the audio processing device 1 has a sound image localization processing filtering unit 10, a trans-aural system filtering unit 20, a speaker rearrangement processing unit 30, a control unit 40, a position detection sensor 50 that is an example of the sensor unit, and real speaker apparatuses SPL and SPR. The audio processing device 1 is supplied with, for example, audio signals of two channels. For this reason, as shown in FIG. 8, the audio processing device 1 has a left channel input terminal Lin that receives supply of a left channel audio signal and a right channel input terminal Rin that receives supply of a right channel audio signal.

The sound image localization processing filtering unit 10 is a filter that performs processing of localizing a sound image at an arbitrary position. The trans-aural system filtering unit 20 is a filter that performs trans-aural processing with respect to an audio signal Lout1 and an audio signal Rout1 which are outputs from the sound image localization processing filtering unit 10.

The speaker rearrangement processing unit 30 that is an example of the correction processing unit is a filter that performs speaker rearrangement processing in accordance with a change in a listening position with respect to an audio signal Lout2 and an audio signal Rout2 which are outputs from the trans-aural system filtering unit 20. An audio signal Lout3 and an audio signal Rout3 which are outputs from the speaker rearrangement processing unit 30 are respectively supplied to the real speaker apparatuses SPL and SPR and a predetermined sound is reproduced. The predetermined sound may be any sound such as music, a human voice, a natural sound, or a combination thereof.

The control unit 40 is constituted by a CPU (Central Processing Unit) or the like and controls the respective units of the audio processing device 1. The control unit 40 has a memory (not illustrated). Examples of the memory include a ROM (Read Only Memory) that stores a program to be executed by the control unit 40 and a RAM (Random Access Memory) to be used as a work memory when the control unit 40 executes the program. Although details will be described later, the control unit 40 is equipped with a function for calculating a viewing angle that is an angle formed by the listening position of the listener U as detected by the position detection sensor 50 and the real speaker apparatuses SPL and SPR. In addition, the control unit 40 acquires an HRTF in accordance with the viewing angle. The control unit 40 may acquire an HRTF in accordance with the viewing angle from its own memory or may acquire an HRTF in accordance with the viewing angle which is stored in another memory. Alternatively, the control unit 40 may acquire an HRTF in accordance with the viewing angle via a network or the like.

The position detection sensor 50 is constituted by, for example, an imaging apparatus and is a sensor that detects a position of the listener U or, in other words, the listening position. The position detection sensor 50 itself may be independent or may be built into another device such as a television apparatus that displays video to be simultaneously reproduced with sound being reproduced from the real speaker apparatuses SPL and SPR. A detection result of the position detection sensor 50 is supplied to the control unit 40.

(Sound Image Localization Processing Filtering Unit)

Figure 9:
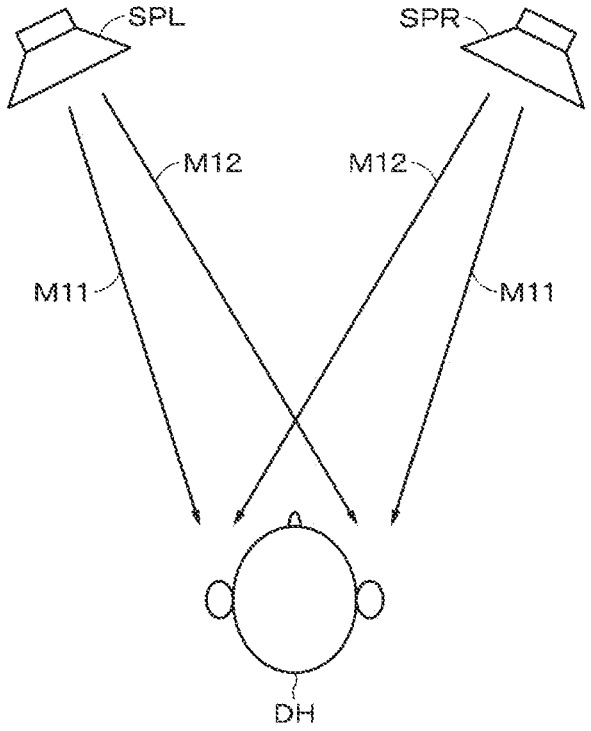
FIG. 9 is a diagram for explaining an example of a transfer function from a speaker apparatus to a dummy head.

Hereinafter, each unit of the audio processing device 1 will be described in detail. First, before describing the sound image localization processing filtering unit 10, a principle of sound image localization processing will be described. FIG. 9 is a diagram for explaining a principle of sound image localization processing.

As shown in FIG. 9, in a predetermined reproduction sound field, it is assumed that a position of a dummy head DH is a position of the listener U, and, to the listener U at a position of the dummy head DH, the real speaker apparatuses SPL and SPR are actually installed at left and right virtual speaker positions (positions where speakers are assumed to be present) where a sound image is to be localized.

In addition, sounds reproduced from the real speaker apparatuses SPL and SPR are collected in both ear portions of the dummy head DH, and HRTF that is a transfer function indicating how sounds reproduced from the real speaker apparatuses SPL and SPR change upon reaching both ear portions of the dummy head DH is to be measured in advance.

As shown in FIG. 9, in the present embodiment, a transfer function of sound from the real speaker apparatus SPL to a left ear of the dummy head DH is denoted by M11 and a transfer function of sound from the real speaker apparatus SPL to a right ear of the dummy head DH is denoted by M12. In a similar manner, a transfer function of sound from the real speaker apparatus SPR to the left ear of the dummy head DH is denoted by M12 and a transfer function of sound from the real speaker apparatus SPR to the right ear of the dummy head DH is denoted by M11.

In this case, processing is performed using the HRTF measured in advance as described above with reference to FIG. 9, and sound based on an audio signal after the processing is reproduced near the ears of the listener U. Accordingly, a sound image of sound reproduced from the real speaker apparatuses SPL and SPR can be localized at an arbitrary position.

While the dummy head DH is used to measure the HRTF, the use of the dummy head DH is not restrictive. A person may be actually asked to take a seat in the reproduction sound field in which the HRTF is to be measured, and the HRTF of sound may be measured by placing a microphone near the ears of the person. Furthermore. The HTRF is not limited to a measured HTRF and may be calculated by a computer simulation or the like. A localization position of a sound image is not limited to two positions of left and right and may be, for example, five locations (positions corresponding to an audio reproduction system with five channels (specifically, center, front left, front right, rear left, and rear right)), in which case HRTF from a real speaker apparatus placed at each position to both ears of the dummy head DH are respectively obtained. In addition to a front-rear direction, a position where a sound image is to be localized may be set in an up-down direction such as a ceiling (above the dummy head DH).

Figure 10:
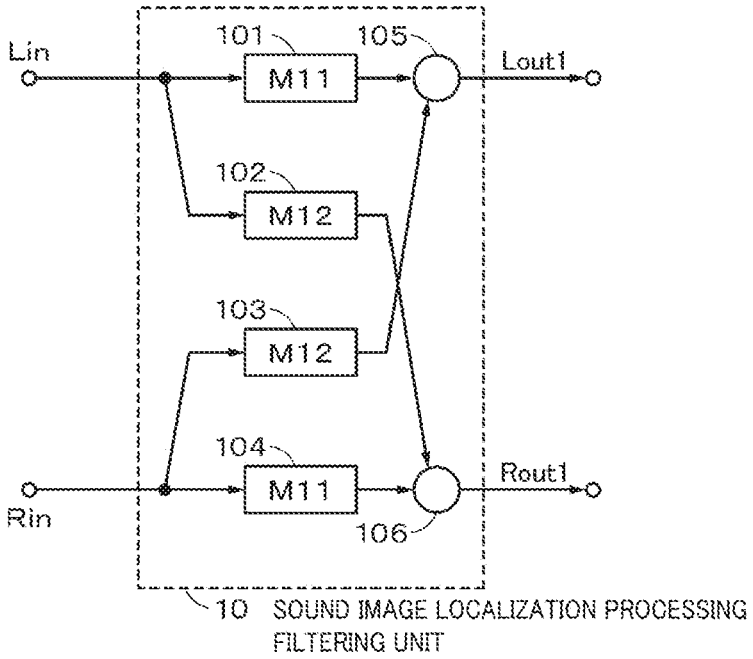
FIG. 10 is a diagram showing a configuration example of a sound image localization processing filtering unit according to the embodiment.

A portion that performs processing by HRTF of sound having been obtained in advance by a measurement or the like in order to localize a sound image at a predetermined position is the sound image localization processing filtering unit 10 shown in FIG. 8. The sound image localization processing filtering unit 10 according to the present embodiment is capable of processing audio signals of two (left and right) channels and is, as shown in FIG. 10, constituted by four filters 101, 102, 103, and 104 and two adders 105 and 106.

The filter 101 processes, with HRTF: M11, an audio signal of the left channel having been supplied through the left channel input terminal Lin and supplies the processed audio signal to the adder 105 for the left channel. In addition, the filter 102 processes, with HRTF: M12, the audio signal of the left channel having been supplied through the left channel input terminal Lin and supplies the processed audio signal to the adder 106 for the right channel.

Furthermore, the filter 103 processes, with HRTF: M12, an audio signal of the right channel having been supplied through the right channel input terminal Rin and supplies the processed audio signal to the adder 105 for the left channel. In addition, the filter 104 processes, with HRTF: M11, the audio signal of the right channel having been supplied through the right channel input terminal Rin and supplies the processed audio signal to the adder 106 for the right channel.

Accordingly, a sound image becomes localized so that a sound according to an audio signal output from the adder 105 for the left channel and a sound according to an audio signal output from the adder 106 for the right channel are reproduced from left and right virtual speaker positions where the sound image is to be localized. An audio signal Lout1 is output from the adder 105 and an audio signal Rout1 is output from the adder 106.

(Trans-Aural System Filtering Unit)

Even if the sound image localization processing by the sound image localization processing filtering unit 10 has been performed, as schematically shown in FIG. 8, when reproduction is performed from the real speaker apparatuses SPL and SPR which are separated from the ears of the listener U, there may be cases where a sound image of the reproduced sound is affected by HRTF {HB1, HB2} in the actual reproduction sound field and cannot be accurately localized at a target position.

In consideration thereof, in the present embodiment, by performing processing using the trans-aural system filtering unit 20 with respect to audio signals output from the sound image localization processing filtering unit 10, sounds reproduced from the real speaker apparatuses SPL and SPR are accurately localized as though reproduced from a predetermined position.

The trans-aural system filtering unit 20 is a sound filter (for example, an FIR (Finite Impulse Response) filter) formed by applying a trans-aural system. The trans-aural system is a technique which attempts to realize, using a speaker apparatus, an effect similar to that produced by a binaural system which is a system for precisely reproducing sound near ears using headphones.

To describe the trans-aural system using the case shown in FIG. 8 as an example, with respect to sounds reproduced from the real speaker apparatuses SPL and SPR, by canceling an effect of HRTF {HB1, HB2} on sound reproduced from each real speaker apparatus until each of left and right ears of the listener U, sounds reproduced from the real speaker apparatuses SPL and SPR are precisely reproduced.

Therefore, with respect to sound to be reproduced from the real speaker apparatuses SPL and SPR, the trans-aural system filtering unit 20 shown in FIG. 8 cancels an effect of HRTF in a reproduction sound field in order to accurately localize a sound image of the sound to be reproduced from the real speaker apparatuses SPL and SPR at a predetermined virtual position.

Figure 11:
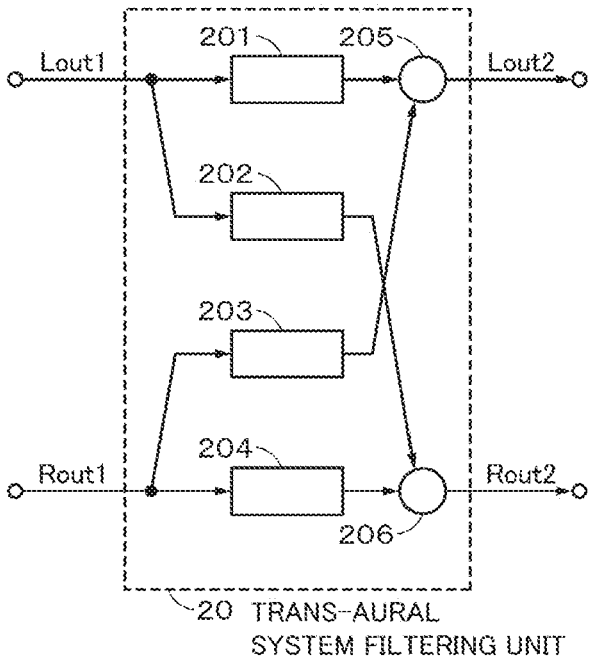
FIG. 11 is a diagram showing a configuration example of a trans-aural system filtering unit according to the embodiment.

As shown in FIG. 11, in order to cancel an effect of HRTF from the real speaker apparatuses SPL and SPR to left and right ears of the listener U, the trans-aural system filtering unit 20 is equipped with filters 201, 202, 203, and 204 and adders 205 and 206 which process audio signals in accordance with an inverse function of HRTF {HB1, HB2} from the real speaker apparatuses SPL and SPR to left and right ears of the listener U. It should be noted that, in the present embodiment, in the filters 201, 202, 203, and 204, processing that also takes inverse filtering characteristics into consideration is performed to enable a more natural reproduction sound to be reproduced.

Each of the filters 201, 202, 203, and 204 performs predetermined processing using a filter coefficient set by the control unit 40. Specifically, each filter of the trans-aural system filtering unit 20 forms an inverse function of HRTF {HB1, HB2} based on coefficient data set by the control unit 40, and by processing an audio signal according to the inverse function, cancels the effect of HRTF {HB1, HB2} in a reproduction sound field.

In addition, output from the filter 201 is supplied to the adder 205 for a left channel and output from the filter 202 is supplied to the adder 206 for a right channel. In a similar manner, output from the filter 203 is supplied to the adder 205 for the left channel and output from the filter 204 is supplied to the adder 206 for the right channel.

Furthermore, each of the adders 205 and 206 adds the audio signals supplied thereto. An audio signal Lout2 is output from the adder 205. In addition, an audio signal Rout2 is output from the adder 206.

(Speaker Rearrangement Processing Unit)

As described above, when the listening position of the listener U is deviated from the service area, an effect of trans-aural processing by the trans-aural system filtering unit 20 diminishes. In consideration thereof, in the present embodiment, the effect of trans-aural processing is prevented from diminishing by performing speaker rearrangement processing by the speaker rearrangement processing unit 30.

Figure 12:
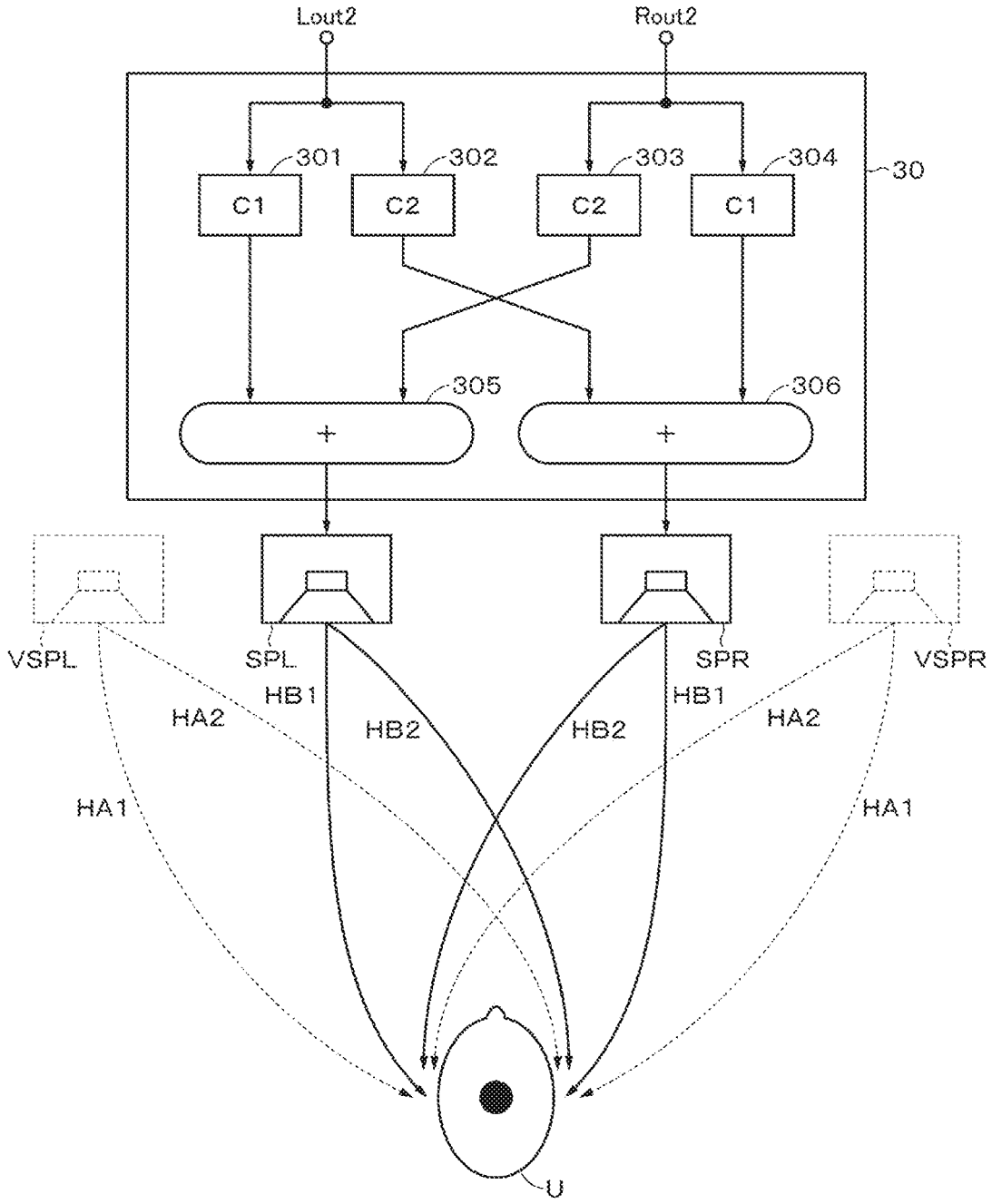
FIG. 12 is a diagram for explaining a configuration example and the like of a speaker rearrangement processing unit according to the embodiment.

FIG. 12 is a diagram showing a configuration example and the like of the speaker rearrangement processing unit 30. The speaker rearrangement processing unit 30 has a filter 301, a filter 302, a filter 303, a filter 304, an adder 305 that adds up an output of the filter 301 and an output of the filter 303, and adder 306 that adds up an output of the filter 302 and an output of the filter 304. In the present embodiment, since the real speaker apparatuses SPL and SPR are arranged at symmetrical positions, a same filter coefficient C1 is set to the filters 301 and 304 and a same filter coefficient C2 is set to the filters 302 and 303.

In a similar manner to previous examples, an HRTF to ears of the listener U who is at a listening position that has deviated from the service area will be denoted by HRTF {HB1, HB2}. In addition, an HRTF to ears of the listener U who is at a listening position that corresponds to the service area will be denoted by HRTF {HA1, HA2}. Positions of the virtual speaker apparatuses VSPL and VSPR depicted by dotted lines in FIG. 12 indicate positions where a viewing angle with the position of the listener U is A [deg] or, in other words, a position where a viewing angle enables an effect of trans-aural processing to be obtained.

By setting the filter coefficients C1 and C2 based on, for example, equations (1) and (2) below, the control unit 40 virtually rearranges positions of the real speaker apparatuses SPL and SPR to speaker apparatuses VSPL and VSPR which are positions of virtual speaker apparatuses. The filter coefficients C1 and C2 are filter coefficients for correcting, to the viewing angle A [deg], an angle that constitutes a deviation with respect to the viewing angle A [deg].

$$C1=(HB1*HA1-HB2*HA2)/(HB1*HB1-HB2*HB2) \quad \text{(Equation 1)}$$

$$C2=(HB1*HA2-HB2*HA1)/(HB1*HB1-HB2*HB2) \quad \text{(Equation 2)}$$

Due to the speaker rearrangement processing unit 30 performing filter processing based on the filter coefficients C1 and C2, the effect of trans-aural processing can be prevented from diminishing even when the listening position of the listener U deviates from the service area. In other words, even when the listening position of the listener U deviates from the service area, a deterioration of a sound image localization effect with respect to the listener U can be prevented.

(Operation Example of Audio Processing Device)

Next, an operation example of the audio processing device 1 will be described. Sound image localization processing by the sound image localization processing filtering unit 10 and trans-aural processing by the trans-aural system filtering unit 20 are performed with respect to an audio signal of a left channel that is input from the left channel input terminal Lin and an audio signal of a right channel that is input from the right channel input terminal Rin. Audio signals Lout2 and Rout2 are output from the trans-aural system filtering unit 20. The audio signals Lout2 and Rout2 are trans-aural signals having been subjected to trans-aural processing.

On the other hand, sensor information related to the listening position of the listener U is supplied to the control unit 40 from the position detection sensor 50. Based on the listening position of the listener U as obtained from the sensor information, the control unit 40 calculates an angle formed by the real speaker apparatuses SPL and SPR and the listening position of the listener U or, in other words, a viewing angle. When the calculated viewing angle is a viewing angle corresponding to a service area, a sound based on the audio signals Lout2 and Rout2 is reproduced from the real speaker apparatuses SPL and SPR without the speaker rearrangement processing unit 30 performing processing.

When the calculated viewing angle is not a viewing angle corresponding to a service area, speaker rearrangement processing by the speaker rearrangement processing unit 30 is performed. For example, the control unit 40 acquires HRTF {HB1, HB2} in accordance with the calculated viewing angle. As an example, when the viewing angle corresponding to the service area is 15 [deg], the control unit 40 has stored HRTF {HB1, HB2} corresponding to each angle ranging from, for example, 5 to 20 [deg] and reads HRTF {HB1, HB2} corresponding to the calculated viewing angle. It should be noted that an angular resolution or, in other words, in what kind of angular increment (for example, 1 or 0.5 [deg]) HRTF {HB1, HB2} is to be stored can be appropriately set.

In addition, the control unit 40 stores HRTF {HA1, HA2} that corresponds to a viewing angle corresponding to the service area. Furthermore, the control unit 40 assigns the read HRTF {HB1, HB2} and HRTF {HA1, HA2} stored in advance to the equations (1) and (2) described above to obtain the filter coefficients C1 and C2. Moreover, the obtained filter coefficients C1 and C2 are appropriately set to filters 301 to 304 of the speaker rearrangement processing unit 30. The speaker rearrangement processing by the speaker rearrangement processing unit 30 is performed using the filter coefficients C1 and C2. An audio signal Lout3 and an audio signal Rout3 are output from the speaker rearrangement processing unit 30. The audio signal Lout3 is reproduced from the real speaker apparatus SPL and the audio signal Rout3 is reproduced from the real speaker apparatus SPR.

According to the first embodiment described above, even when the listening position of the listener U deviates from the service area, the effect of trans-aural processing can be prevented from diminishing.

Second Embodiment

Next, a second embodiment will be described. In the second embodiment, a configuration that is the same or homogeneous to that of the first embodiment is assigned a same reference sign. In addition, matters described in the first embodiment can also be applied to the second embodiment unless specifically stated to the contrary.

In the first embodiment, a case where the listening position of the listener U deviates in a front-rear direction from a service area is supposed. In other words, a case is supposed where an approximately symmetrical arrangement of the real speaker apparatuses SPL and SPR with respect to the listening position of the listener U is maintained even when the listening position deviates from a servile area. However, the listener U may move in a left-right direction in addition to the front-rear direction with respect to a speaker apparatus. In other words, a case is also supposed where the listening position after movement is a position having deviated from the service area and the approximately symmetrical arrangement of the real speaker apparatuses SPL and SPR with respect to the listening position is not maintained. The second embodiment is an embodiment that corresponds to such a case.

(Configuration Example of Audio Processing Device)

Figure 13:
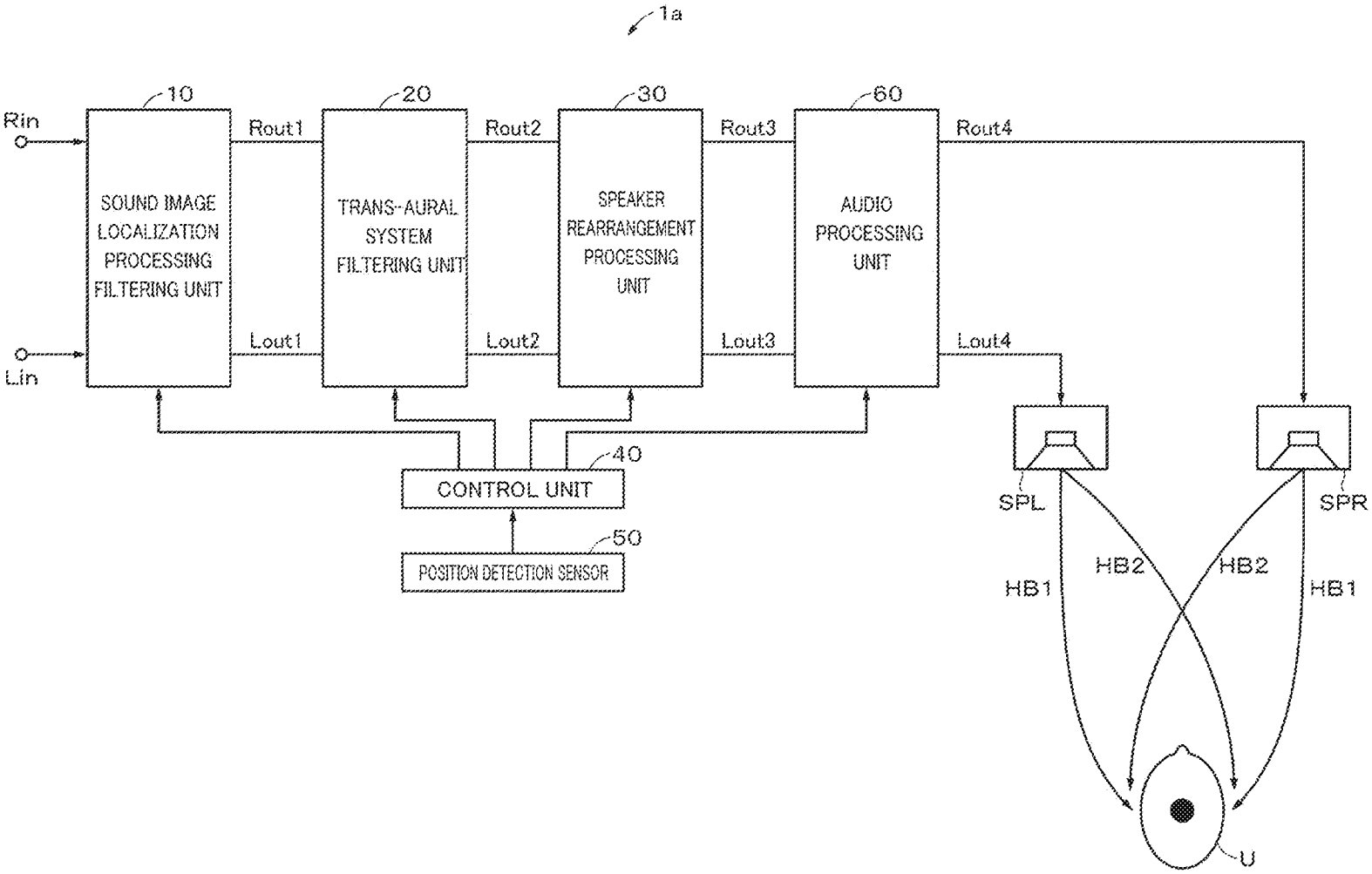
FIG. 13 is a diagram for explaining a configuration example of an audio processing device according to a second embodiment.

FIG. 13 is a block diagram showing a configuration example of an audio processing device (an audio processing device 1*a*) according to the second embodiment. The audio processing device 1*a* differs from the audio processing device 1 according to the first embodiment in that the audio processing device 1*a* has an audio processing unit 60. The audio processing unit 60 is provided in, for example, a stage subsequent to the speaker rearrangement processing unit 30.

The audio processing unit 60 performs predetermined audio processing on audio signals Lout3 and Rout3 that are outputs from the speaker rearrangement processing unit 30. The predetermined audio processing is, for example, at least one of processing for making arrival times at which audio signals respectively reproduced from two real speaker apparatuses SPL and SPR reach a present listening position approximately equal and processing for making levels of audio signals respectively reproduced from the two real speaker apparatuses SPL and SPR approximately equal. It should be noted that being approximately equal includes being completely equal and means that the arrival times or levels of sound reproduced from the two real speaker apparatuses SPL and SPR may contain an error that is equal to or smaller than a threshold which does not invoke a sense of discomfort in the listener U.

Audio signals Lout4 and Rout4 which are audio signals subjected to audio processing by the audio processing unit 60 are output from the audio processing unit 60. The audio signal Lout4 is reproduced from the real speaker apparatus SPL and the audio signal Rout4 is reproduced from the real speaker apparatus SPR.

(Operation Example of Audio Processing Device)

Figure 14:
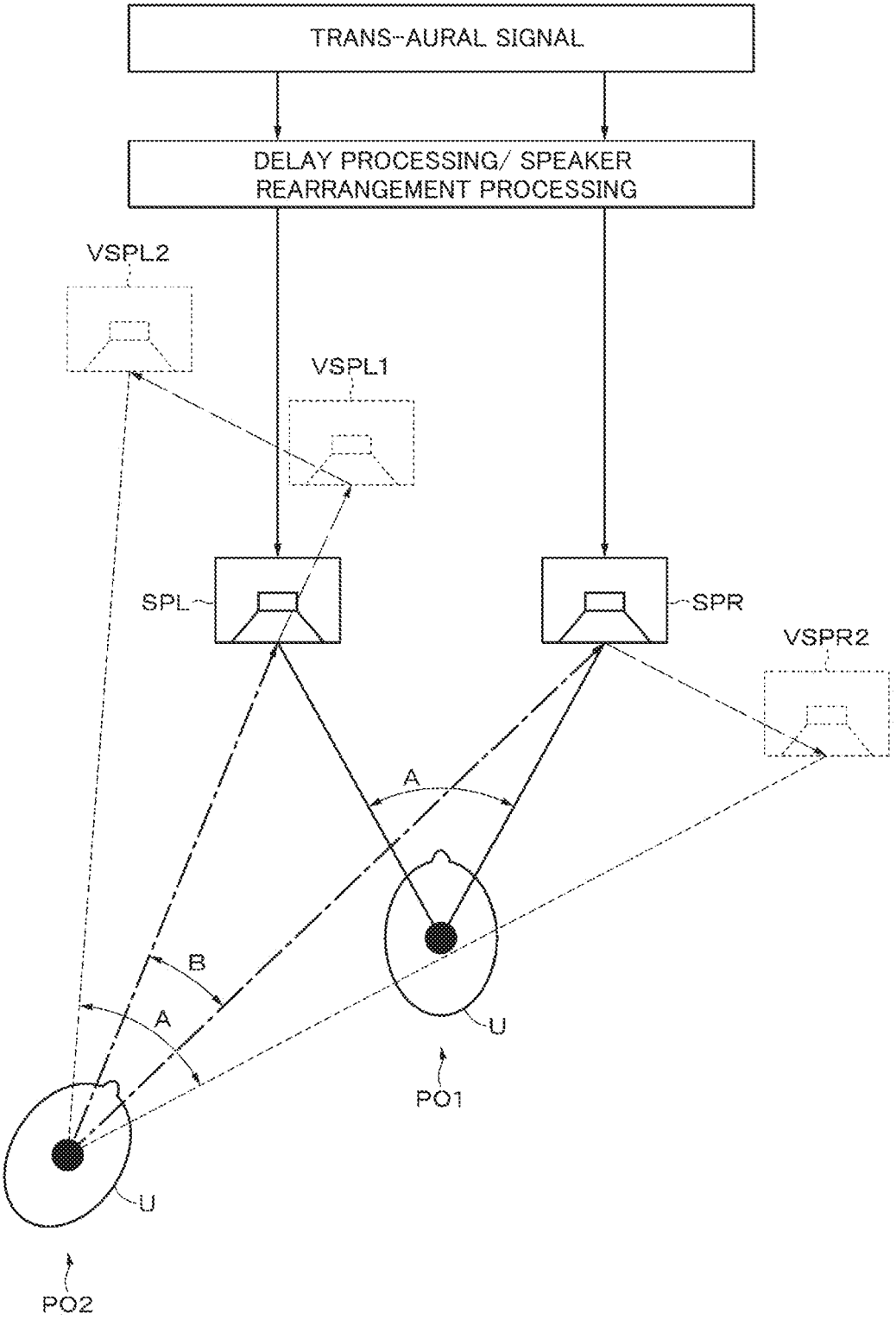
FIG. 14 is a diagram for explaining an operation example of the audio processing device according to the second embodiment.

Next, an operation example of the audio processing device 1*a* will be described with reference to FIG. 14. FIG. 14 shows a listener U who listens to sound at a listening position PO1 (with a viewing angle of A [deg]) that corresponds to a service area. Now, let us assume a case where, for example, the listener U moves to a listening position PO2 on a diagonally backward left side in FIG. 14 and the listening position deviates from the service area. The movement of the listener U is detected by the position detection sensor 50. Sensor information detected by the position detection sensor 50 is supplied to the control unit 40.

Based on the sensor information supplied from the position detection sensor 50, the control unit 40 identifies the listening position PO2. In addition, the control unit 40 sets a virtual speaker apparatus VSPL1 so that a predetermined location on a virtual line segment that extends forward from the listening position PO2 (specifically, generally, on a virtual line segment that extends in a direction to which the face of the listener U is turned) is approximately midway between the virtual speaker apparatus VSPL1 and the real speaker apparatus SPR. With the situation as it is, as shown in FIG. 14, a viewing angle formed by the listening position PO2 of the listener U, the real speaker apparatus SPR, and the virtual speaker apparatus VSPL1 is B [deg] that is smaller than A [deg] and a trans-aural effect diminishes. Therefore, processing by the speaker rearrangement processing unit 30 is performed so that the viewing angle B [deg] becomes A [deg].

Since the processing by the speaker rearrangement processing unit 30 has already been described in the first embodiment, only a brief description will be given here. The control unit 40 acquires an HRTF {HB1, HB2} in accordance with the viewing angle B [deg]. The control unit 40 acquires filter coefficients C1 and C2 based on the equations (1) and (2) described in the first embodiment and appropriately sets the acquired filter coefficients C1 and C2 to the filters 301, 302, 303, and 304 of the speaker rearrangement processing unit 30. Based on the filter coefficients C1 and C2, the processing by the speaker rearrangement processing unit 30 is performed so that positions of the real speaker apparatuses SPL and SPR are virtually rearranged at speaker apparatuses VSPL2 and VSPR2, and audio signals Lout3 and Rout3 are output from the speaker rearrangement processing unit 30.

The audio processing unit 60 executes determined audio processing on the audio signals Lout3 and Rout3 in accordance with control by the control unit 40. For example, the audio processing unit 60 performs audio processing for making arrival times at which audio signals reproduced from the real speaker apparatuses SPL and SPR reach the listening position PO2 approximately equal. For example, the audio processing unit 60 performs delay processing on the audio signal Lout3 to make arrival times at which audio signals respectively reproduced from the two real speaker apparatuses SPL and SPR reach the listening position PO2 approximately equal.

It should be noted that an amount of delay may be appropriately set based on a distance difference between the real speaker apparatus SPL and the virtual speaker apparatus VSPL. In addition, for example, an amount of delay may be set so that, when a microphone is arranged at the listening position PO2 of the listener U, times of arrival of respective audio signals from the real speaker apparatuses SPL and SPR as detected by the microphone at the listening position PO2 are made approximately equal. The microphone may be a stand-alone microphone, or a microphone built into another device such as a remote control apparatus of a television apparatus or a smart phone may be used. According to the processing, arrival times of sounds reproduced from the real speaker apparatuses SPL and SPR with respect to the listener U at the listening position PO2 are made approximately equal. It should be noted that processing for adjusting signal levels or the like may be performed by the audio processing unit 60 when necessary.

According to the processing by the audio processing unit 60, the arrival times at which audio signals reproduced from the real speaker apparatuses SPL and SPR reach the listening position PO2 are made approximately equal. An audio signal Lout4 and an audio signal Rout4 are output from the audio processing unit 60. The audio signal Lout4 is reproduced from the real speaker apparatus SPL and the audio signal Rout4 is reproduced from the real speaker apparatus SPR. The second embodiment described above also produces an effect similar to that of the first embodiment.

Modifications of Second Embodiment

While an example in which delay processing is performed so as to distance the real speaker apparatus SPL to a position of the virtual speaker apparatus VSPL1 has been described in the second embodiment above, delay processing may be performed so as to cause the real speaker apparatus SPR to approach the position of the virtual speaker apparatus VSPL1.

<Modifications>

While an embodiment of the present disclosure has been described with specificity above, it is to be understood that contents of the present disclosure are not limited to the embodiment described above and that various modifications can be made based on the technical ideas of the present disclosure.

In the embodiment described above, the audio processing devices 1 and 1*a* may be configured without the position detection sensor 50. In this case, calibration (adjustment) is performed prior to listening to sound (which may be synchronized with video) that is a content. For example, the calibration is performed as follows. The listener U reproduces an audio signal at a predetermined listening position. At this point, the control unit 40 performs control to change HRTF {HB1, HB2} in accordance with the viewing angle or, in other words, change the filter coefficients C1 and C2 with respect to the speaker rearrangement processing unit 30 and reproduce the audio signal. The listener U issues an instruction to the audio processing device once a predetermined sense of localization in terms of auditory sensation is obtained. Upon receiving the instruction, the audio processing device sets the filter coefficients C1 and C2 to the speaker rearrangement processing unit 30. As described above, a configuration in which settings related to speaker rearrangement processing are configured by the user may be adopted.

After the calibration, the actual content is reproduced. According to the present example, the position detection sensor 50 can be rendered unnecessary. In addition, since the listener U configures settings based on his/her own auditory sensation, the listener U can gain a feeling of being convinced. Alternatively, when calibration is performed, on the assumption that the listening position does not change significantly after the calibration, the filter coefficients C1 and C2 may be prevented from being changed even when the listening position deviates.

Instead of performing calibration, processing described in the embodiment may be performed in real-time as reproduction of contents proceeds. However, performing the processing described above even when the listening position slightly deviates may generate a sense of discomfort in terms of auditory sensation. In consideration thereof, the processing described in the embodiment may be configured to be performed when the listening position of the listener U deviates by a predetermined amount or more.

The filter coefficients C1 and C2 to be set to the speaker rearrangement processing unit 30 may be calculated by a method other than equations (1) and (2) described earlier. For example, the filter coefficients C1 and C2 may be calculated by a more simplified method than the calculation method using the equations (1) and (2). In addition, as the filter coefficients C1 and C2, filter coefficients calculated in advance may be used. Furthermore, from filter coefficients C1 and C2 that correspond to two given viewing angles, filter coefficients C1 and C2 corresponding to a viewing angle between the two viewing angles may be calculated by interpolation.

When a plurality of listeners are detected by the position detection sensor 50, the processing described above may be performed by prioritizing a listening position of a listener who is at a listening position where two speaker apparatuses take symmetrical positions.

The present disclosure can also be applied to multichannel systems that reproduce audio signals other than 2-channel systems. In addition, the position detection sensor 50 is not limited to an imaging apparatus and may be other sensors. For example, the position detection sensor 50 may be a sensor that detects a position of a transmitter being carried by the user.

Configurations, methods, steps, shapes, materials, numerical values, and the like presented in the embodiment described above are merely examples and, when necessary, different configurations, methods, steps, shapes, materials, numerical values, and the like may be used. The embodiment and the modifications described above can be combined as appropriate. In addition, the present disclosure may be a method, a program, or a medium storing the program. For example, the program is stored in a predetermined memory included in an audio processing device.

The present disclosure can also adopt the following configurations.

(1)

An audio processing device, comprising:

a trans-aural processing unit configured to perform trans-aural processing with respect to a predetermined audio signal; and a correction processing unit configured to perform correction processing in accordance with a change in a listening position with respect to the audio signal having been subjected to the trans-aural processing.

(2)

The audio processing device according to (1), wherein the change in the listening position is a deviation between an angle formed by at least three points having, as vertices, positions of two speaker apparatuses and the listening position and a predetermined angle.

(3)

The audio processing device according to (2), wherein the predetermined angle is an angle set in advance.

(4)

The audio processing device according to (2) or (3), wherein the correction processing unit is configured to perform processing for virtually rearranging positions of two real speaker apparatuses to positions of two virtual speaker apparatuses such that an angle formed by the positions of the virtual speaker apparatuses and the listening position matches the predetermined angle.

(5)

The audio processing device according to any one of (2) to (4), wherein the correction processing unit is constituted by a filter, and the correction processing unit is configured to perform correction processing using a filter coefficient that corrects an angle at which the deviation has occurred to the predetermined angle.

(6)

The audio processing device according to (4), wherein the listening position is set at a predetermined position on an axis that passes a center point between the two real speaker apparatuses.

(7)

The audio processing device according to (4) or (6), performing at least one of processing for making arrival times at which audio signals respectively reproduced from the two real speaker apparatuses reach the listening position approximately equal and processing for making levels of audio signals respectively reproduced from the two real speaker apparatuses approximately equal.

(8)
The audio processing device according to any one of (1) to (7), comprising
a sensor unit configured to detect the listening position.
(9)
The audio processing device according to any one of (1) to (8), comprising
a real speaker apparatus configured to reproduce an audio signal having been subjected to correction processing by the correction processing unit.
(10)
The audio processing device according to any one of (1) to (9), configured such that settings related to the correction processing are to be made by a user.
(11)
An audio processing method, comprising:
performing, by a trans-aural processing unit, trans-aural processing with respect to a predetermined audio signal; and
performing, a correction processing unit, correction processing in accordance with a change in a listening position with respect to the audio signal having been subjected to the trans-aural processing.
(12)
A program that causes a computer to execute an audio processing method comprising:
performing, by a trans-aural processing unit, trans-aural processing with respect to a predetermined audio signal; and
performing, by a correction processing unit, correction processing in accordance with a change in a listening position with respect to the audio signal having been subjected to the trans-aural processing.

REFERENCE SIGNS LIST

1, 1*a* Audio processing device
20 Trans-aural system filtering unit
30 Speaker rearrangement processing unit
40 Control unit
50 Position detection sensor
SPL, SPR Real speaker apparatus
VSPL, VSPR Virtual speaker apparatus

The invention claimed is:

1. An audio processing device, comprising:
a trans-aural processing unit configured to perform a trans-aural processing operation with respect to an audio signal; and
a correction processing unit configured to perform a correction processing operation based on a change in a listening position with respect to the audio signal subjected to the trans-aural processing operation, wherein
the change in the listening position is a deviation from a first angle to a second angle,
the first angle is an internal angle formed by pair of a first straight line and a second straight line,
the first straight line is between a first speaker apparatus of two speaker apparatuses and the listening position,
the second straight line is between a second speaker apparatus of the two speaker apparatuses and the listening position,
the second angle is set in advance to the trans-aural processing operation,
the correction processing unit comprises a plurality of filters,
the correction processing operation is performed using an inverse function of Head related transfer function (HRTF) associated with each filter of the plurality of filters, and
the inverse function is based on a plurality of filter coefficients that corrects the first angle at which the deviation has occurred to the second angle.

2. The audio processing device according to claim 1, wherein the correction processing unit is further configured to virtually rearrange positions of two real speaker apparatuses to positions of two virtual speaker apparatuses such that a third angle formed by the positions of the virtual speaker apparatuses and the listening position matches the second angle.

3. The audio processing device according to claim 2, wherein the listening position is set at a specific position on an axis that passes a center point between the two real speaker apparatuses.

4. The audio processing device according to claim 2, further comprising a sound image localization processing unit configured to:
make arrival times, at which each audio signal reproduced from each real speaker apparatus of the two real speaker apparatuses reach the listening position, approximately equal, or
make a signal level, of each audio signal of a plurality of audio signals reproduced from the two real speaker apparatuses, approximately equal.

5. The audio processing device according to claim 1, further comprising a sensor unit configured to detect the listening position.

6. The audio processing device according to claim 1, wherein
the first speaker apparatus is a real speaker apparatus, and
the real speaker apparatus is configured to reproduce the audio signal subjected to the correction processing operation by the correction processing unit.

7. The audio processing device according to claim 1, wherein the correction processing operation is based on user settings.

8. An audio processing method, comprising:
performing, by a trans-aural processing unit, a trans-aural processing operation with respect to an audio signal; and
performing, a correction processing unit, a correction processing operation based on a change in a listening position with respect to the audio signal subjected to the trans-aural processing operation, wherein
the change in the listening position is a deviation from a first angle to a second angle,
the first angle is an internal angle formed by pair of a first straight line and a second straight line,
the first straight line is between a first speaker apparatus of two speaker apparatuses and the listening position,
the second straight line is between a second speaker apparatus of the two speaker apparatuses and the listening position,
the second angle is set in advance to the trans-aural processing operation,
the correction processing operation is performed using an inverse function of Head related transfer function (HRTF) associated with each filter of a plurality of filters, and
the inverse function is based on a plurality of filter coefficients that corrects the first angle at which the deviation has occurred to the second angle.

9. A non-transitory computer-readable medium having stored thereon, computer-executable instructions which, when executed by a computer, cause the computer to execute operations, the operations comprising:

performing a trans-aural processing operation with respect to an audio signal; and performing a correction processing operation based on a change in a listening position with respect to the audio signal subjected to the trans-aural processing operation, wherein the change in the listening position is a deviation from a first angle to a second angle, the first angle is an internal angle formed by pair of a first straight line and a second straight line, the first straight line is between a first speaker apparatus of two speaker apparatuses and the listening position, the second straight line is between a second speaker apparatus of the two speaker apparatuses and the listening position, the second angle is set in advance to the trans-aural processing, the correction processing operation is performed using an inverse function of Head related transfer function (HRTF) associated with each filter of a plurality of filters, and the inverse function is based on a plurality of filter coefficients that corrects the first angle at which the deviation has occurred to the second angle.

* * * * *